US008525700B2

(12) United States Patent
Rejali et al.

(10) Patent No.: US 8,525,700 B2
(45) Date of Patent: Sep. 3, 2013

(54) CONTROL SYSTEM AND A METHOD FOR INFORMATION DISPLAY SYSTEMS FOR VEHICLES ON CROSS ROADS

(76) Inventors: Mohammadreza Rejali, Isfahan (IR); Mojtaba Tavanaei Pooya, Isfahan (IR)

( * ) Notice: Subject to any disclaimer, the term of this patent is extended or adjusted under 35 U.S.C. 154(b) by 452 days.

(21) Appl. No.: 12/873,422

(22) Filed: Sep. 1, 2010

(65) Prior Publication Data

US 2011/0025528 A1 Feb. 3, 2011

Related U.S. Application Data

(60) Provisional application No. 61/309,441, filed on Mar. 2, 2010.

(51) Int. Cl.
*G08G 1/07* (2006.01)

(52) U.S. Cl.
USPC ..... 340/909; 340/905; 340/910; 40/606.14

(58) Field of Classification Search
USPC ..... 340/901, 905, 909–915; 705/14.4, 705/14.62, 14.63; 40/624, 606.14, 606.15; 248/186.1, 176.3, 183.1, 323, 326, 327, 333
See application file for complete search history.

(56) References Cited

U.S. PATENT DOCUMENTS 5,471,775 A * 12/1995 Hoyt et al. ..... 40/601
7,121,029 B2 * 10/2006 Wilson ..... 40/601
7,428,882 B2 * 9/2008 Keil ..... 119/753
7,830,600 B2 * 11/2010 Jiang ..... 359/461
8,240,321 B2 * 8/2012 Fountain et al. ..... 134/172
2002/0008637 A1 * 1/2002 Lemelson et al. ..... 340/907
2007/0257817 A1 * 11/2007 Mahoney ..... 340/929
2008/0216371 A1 * 9/2008 Beale et al. ..... 40/624
2009/0284395 A1 * 11/2009 Bushman ..... 340/907

* cited by examiner

*Primary Examiner* — Brian Zimmerman
*Assistant Examiner* — Laura Nguyen
(74) *Attorney, Agent, or Firm* — Barry Choobin; Patent 360 LLC

(57) ABSTRACT

The various embodiments herein provide a system and method for managing information display for vehicles on cross roads. The system includes at least one panel to display a traffic regulatory information and advertisements, a central server, a programmable logic controller (PLC) connected to the central server, a plurality of sensors to detect the at least one panel position and any moving foreign objects. A display unit is managed online from a traffic control center to receive and display a real-time traffic information and a plurality of timers are provided for calculating a time schedule information of the traffic lights based on the traffic. The sensors control and transmit the time schedule information to the PLC. The time schedule information and traffic algorithms are transmitted by the PLC to a central control system for processing and estimating an optimum time schedule of traffic lights.

14 Claims, 16 Drawing Sheets

CONTROL SYSTEM AND A METHOD FOR INFORMATION DISPLAY SYSTEMS FOR VEHICLES ON CROSS ROADS

CROSS-REFERENCE TO RELATED APPLICATION

This application claims the priority under 35 USC 119(e) of U.S. Provisional Application Ser. No. 61/309,441, filed on Mar. 2, 2010, which is included by reference herein.

BACKGROUND

1. Technical Field

The embodiments herein generally relate to information display systems and methods and particularly to a control system and method for managing the display of information for vehicles on cross roads. The embodiments herein more particularly relates to a control system and the method for employing a mass media in use during red light period in cross roads for displaying advertisements and traffic regulatory information.

2. Description of the Related Art

Often, drivers get stuck in their vehicles and spend a lot of time during red light at traffic signals, along a drive during ones day. It is common for the drivers to wait for a long period of time on the red light even when there is little or no traffic flow from opposite or adjacent direction of the cross road. The time spent is an extended period of time where drivers closely watch the change of lights in order to proceed forward. The time spent is one of national consumption and this wasted time is termed as "Dead time". Further, the time drivers spent in front of red lights are of great value from the advertising point of view and delivery of traffic regulatory information.

There are various methods implemented for automatic communication of information regarding traffic conditions in real time to the drivers to enable traffic control management. In one of the existing scheme, the panels designed for delivering traffic regulatory information are small in size and installed at low elevation and besides the cross road which are partially visible. Moreover, there is no communication system to deliver effective information related to medicine, arts, science, cultural, traffics, advertisement and other aspects to the society. Yet in another existing scheme, a traffic information media disturbs the driver's concentration during driving thereby increasing the chances of the drivers to meet with an accident and is less effective.

Hence there is a need for an efficient information display control system and method for vehicles on cross roads by deploying a mass media during red light period in cross roads for displaying at least one of general information and traffic regulatory information.

The abovementioned shortcomings, disadvantages and problems are addressed herein and which will be understood by reading and studying the following specification.

OBJECTS OF THE EMBODIMENTS

The primary object of the embodiments herein is to provide a control system and method for displaying information to vehicle users while the vehicles are at cross roads.

Another object of the embodiments herein is to provide a control system and the method for employing a mass media during red light period in cross roads for advertising general information and traffic regulatory information.

Yet another object of the embodiments herein is to provide an information display control system and method for delivering effective information related to medicine, arts, science, cultural, traffics, advertisement and other aspects to the society.

Yet another object of the embodiments herein is to provide an information display control system and method including at least one of a fabric panel or a LCD panel designed for delivering traffic regulatory information and installed at higher elevation in front of the cross road for clear visibility.

Yet another object of the embodiments herein is to provide an information display control system and method including a display unit which can be managed online in the cross roads to inform the drivers an optimal way to be adapted based on the online messages displayed on the display unit.

Yet another object of the embodiments herein is to provide a control system and a method for identifying vehicle plate numbers of an offender across the cross road.

These and other objects and advantages of the present invention will become readily apparent from the following detailed description taken in conjunction with the accompanying drawings.

SUMMARY

The various embodiments herein provide a system and a method for managing information display for vehicles on cross roads. The embodiments herein provide a control system and a method employing a mass media in use during red light period in cross roads for advertising general information and traffic regulatory information. Examples of the traffic regulatory information include, but are not limited to an information associated to traffic signs, speed limit of a vehicle, status of the traffic signal and information indicating change in direction of travel to adjacent streets during traffic.

According to one embodiment, the control system includes at least one panel arranged between two adjacent lines on a street to display at least one of a traffic regulatory information and advertisements and a central server. A programmable logic controller (PLC) is connected to the central server through a wired network or a wireless network, to manage information displayed on the at least one panel based on traffic light status. Also, the system includes a plurality of sensors arranged at a defined elevation to detect the at least one panel position and any moving foreign objects.

A display unit is managed online from a traffic control centre to receive real-time traffic information and a plurality of timers are provided for calculating time schedule information of the traffic lights based on the traffic. The plurality of sensors controls the time schedule information and transmits the time schedule information to the PLC. Further, the time schedule information and traffic algorithms are transmitted by the PLC to a central control system residing in the central server in an online mode for processing and estimating optimum time schedule of the traffic lights for adjacent cross roads for display on the panel. An encoder is provided in the control system for controlling vertical motion of the at least one panel and reporting actual position of the at least one panel to the PLC. The display unit is connected to plurality of cameras associated with the traffic control centre to obtain real-time information related to various traffic events on adjacent streets.

Further, the PLC includes a central processing unit for processing input and output operations of the PLC, a communication interface is provided in electronic communication with the central processing unit, a programming unit is provided for loading an algorithm for managing position of the at least one panel based on the traffic light status across the cross road. Also the PLC includes an input module for receiving time scheduled information from the plurality of sensors based on the traffic and an output module is provided for transmitting one of a start signal or stop signal for an electric motor starter and delivering time schedule information for displaying.

The control system further comprises a movement control mechanism for vertical movement of the at least one panel on the cross road. The movement control mechanism includes at least two telescopic arms provided for vertical motion of the at least one panel. An Electric motor is provided for converting electrical power into mechanical power. A gear box is provided for converting the electrical power into the mechanical power. A chain type transmission arrangement and a magnetic coupler are placed between the electric motor and the chain type transmission arrangement. The telescopic arms includes a first movable part, a second movable part and a third movable part all embedded into a fourth fixed part, connected to each other by an internal wire cable. With respect to the telescopic arms, the velocity of the second movable part is two third velocity of the first moveable part and velocity of the third movable part is one third the velocity of the first movable part during an upward motion of the panel. The pluralities of sensors are activated during an electrical power interruption and network disabilities to retract the panel from a downward position. The panel is made up of a fabric panel or a LED panel. A drum is provided in the movement control mechanism for winding and unwinding the fabric on to the drum by rotation of the drum around its axis during an upward motion and downward motion of the fabric panel respectively.

During the upward or downward motion of the panel, a mechanical power is transmitted from the magnetic coupler and the chain type transmission arrangement to the drum and to the telescopic arms for vertical motion. A counterweight arrangement is provided in the movement control mechanism for the upward movement of the panel during the electric power interruption period. A tensioner is provided in the movement control mechanism for reducing an extra length and shortening of the fabric panel caused during the downward movement of the fabric panel. An AC drive is provided for controlling the speed of the electric motor and to prevent a shock during start and stop condition of the movement control mechanism. The PLC along with the sensors and the AC drive are embedded in a steel control panel. The fabric panel along with the two telescopic arms move downwards upon reception of a yellow light signal from the other side of the cross road and the fabric panel along with the two telescopic arms move upwards upon reception of succeeding yellow light signal from the other side of the cross road.

According to one embodiment herein, the method for managing information display for vehicles on cross roads includes sensing for a green light signal from other side of the cross road. Once the green light is sensed, an information display panel is moved upwards. Further, a yellow light signal is detected and received from other side of the cross road. Following the reception of the yellow light signal a downward command signal is activated for downward motion of at least one panel and current position of the panel is reported to a Programmable Logic Controller (PLC). The PLC is programmed with an algorithm for managing the at least one panel based on traffic light status across the cross road. Also the method includes sensing for a succeeding yellow light signal. Following the reception of the succeeding yellow light signal, the succeeding yellow light signal is received and an upward command signal is activated simultaneously for upward motion of the panel.

Further the method includes checking a duration with respect to set points for each of the sensing of the green light signal, receiving and detecting the green light signal, detecting and receiving the yellow light signal, the activation of the downward command signal, sensing the succeeding yellow light signal, receiving the succeeding yellow light signal, and the activation of the upward command signal operations. During a fault mode condition in which the set point crosses a predefined value, the upward command signal is activated for the upward motion of the panel.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
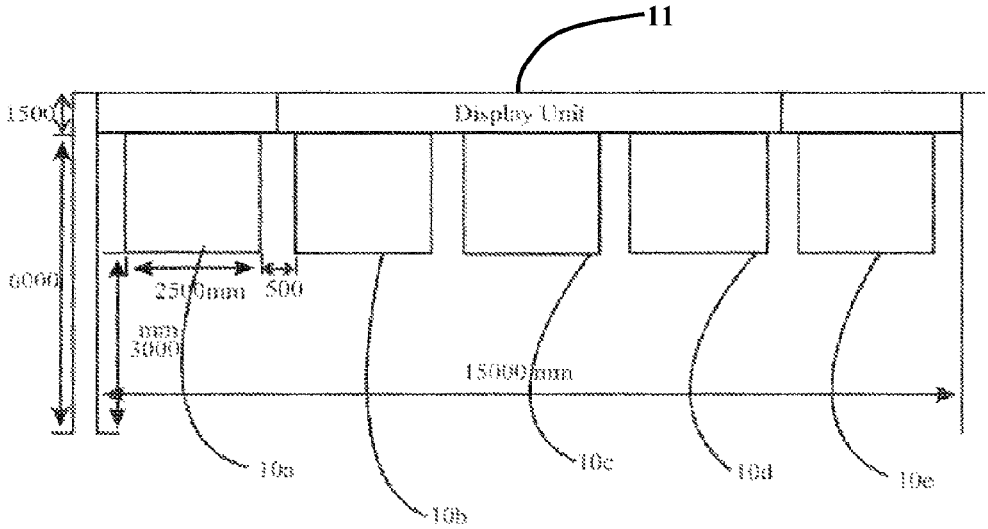
FIG. 1 illustrates a top view of a street accommodating panels and a display unit according to an embodiment of the present disclosure.

Although the specific features of the present invention are shown in some drawings and not in others. This is done for convenience only as each feature may be combined with any or all of the other features in accordance with the present invention.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The foregoing description of the specific embodiments will so fully reveal the general nature of the embodiments herein that others can, by applying current knowledge, readily modify and/or adapt for various applications such specific embodiments without departing from the generic concept and therefore such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

The various embodiments herein provide a system and a method for managing information display for vehicles on cross road. The embodiments herein provide a control system and a method employing a mass media in use during red light period in cross roads for advertising general information and traffic regulatory information. Examples of the traffic regulatory information include, but are not limited to an information associated to traffic signs, speed limit of a vehicle, status of the traffic signal and information indicating change in direction of travel to adjacent streets during traffic.

According to one embodiment, the control system for managing the information display for vehicles on cross road includes at least one panel arranged between two adjacent lines on a street to display at least one of a traffic regulatory information and advertisements, a central server and a programmable logic controller (PLC). The PLC is connected to the central server through one of a wired network or a wireless network to manage the information displayed on the at least one panel based on traffic light status. Also, the system includes a plurality of sensors arranged at a defined elevation to detect the at least one panel position and any moving foreign objects.

A display unit is managed online from a traffic control centre to receive real-time traffic information. Further a plurality of timers is provided for calculating a time schedule information of the traffic lights based on the traffic. The plurality of sensors controls the time schedule information and transmits the time schedule information to the PLC. Further the time schedule information and traffic algorithms are transmitted from the PLC to a central control system residing at the central server in an online mode for processing and estimating the optimum time schedule of the traffic lights for adjacent cross roads for display on the panel. An encoder is provided in the control system for controlling a vertical motion of the at least one panel and reporting actual position of the at least one panel to the PLC. The display unit is connected to a plurality of cameras associated with the traffic control centre to obtain real-time information related to various traffic events on adjacent streets.

Further, the PLC includes a central processing unit for processing input and output operations of the PLC, a communication interface in electronic communication with the central processing unit and a programming unit for loading an algorithm for managing position of the at least one panel based on the traffic light status across the cross road. Also the PLC includes an input module for receiving time scheduled information from the plurality of sensors based on the traffic and an output module for transmitting one of a start signal or stop signal for an electric motor starter and delivering time schedule information for display in the at least one panel.

The control system further comprises a movement control mechanism for the vertical movement of the at least one panel on the cross road. The movement control mechanism includes at least two telescopic arms provided for the vertical motion of the at least one panel, an electric motor, a gear box, a chain type transmission arrangement and a magnetic coupler which is placed between the electric motor and the chain type transmission arrangement. The telescopic arms include a first movable part, a second movable part, a third movable part and a fourth fixed part. The first movable part, a second movable part and a third movable parts are connected to each other by an internal wire cable and embedded into the fourth fixed part. With respect to the telescopic arms, the velocity of the second movable part is two third velocity of the first moveable part and velocity of the third movable part is one third the velocity of the first movable part during an upward motion of the panel. The pluralities of sensors are activated during an electrical power interruption and network impairments to retract the panel from the downward position. The panel is made up of one of a fabric panel or a LED panel. A drum is provided in the movement control mechanism for winding and unwinding the fabric on to the drum by rotation of the drum around its axis during the upward motion and the downward motion of the fabric panel respectively.

During the upward or downward motion of the panel, a mechanical power is transmitted from the magnetic coupler and the chain type transmission arrangement to the drum and to the telescopic arms for vertical motion. A counterweight arrangement is provided in the movement control mechanism for upward movement of the panel during the electric power interruption. A tensioner is provided in the movement control mechanism for reducing an extra length and for shortening the length of the fabric panel caused during the downward movement of the fabric panel. An AC drive is provided for controlling the speed of the electric motor and to prevent a shock during the start-up and stop condition of the movement control mechanism. The PLC along with the sensors and the AC drive are embedded in a steel control panel. The fabric panel along with the two telescopic arms move downwards upon the reception of a yellow light signal from the other side of the cross road and the fabric panel along with the two telescopic arms move upwards upon the reception of a succeeding yellow light signal from the other side of the cross road.

According to one embodiment, the method for managing information display for vehicles on cross road includes sensing for a green light signal from at least one opposite side of the cross road. When the green light is sensed, the green light signal is received from the at least one opposite side of the cross road. Further, a yellow light signal is detected and received from the least one opposite side of the cross road. Following the reception of the yellow light signal, a downward command signal is activated for the downward motion of the at least one panel and the current position of the panel is reported to a Programmable Logic Controller (PLC). The PLC is programmed with an algorithm for managing the at least one panel based on the traffic light status across the cross road. Also the method includes sensing for a succeeding yellow light signal. Following the reception of the succeeding yellow light signal, an upward command signal is activated simultaneously for the upward motion of the panel.

Further the method includes checking the duration of the traffic signals with respect to the set points for each of the sensing of the green light signal, receiving of the green light signal, detecting the yellow light signal, receiving the yellow light signal, the activation of the downward command signal, sensing the succeeding yellow light signal, receiving the succeeding yellow light signal, and the activation of the upward command signal operations. During a fault mode condition in which the set points cross the predefined value, the upward command signal is activated for the upward motion of the panel.

In various embodiments of the present disclosure, the control system is used to manage the information display for vehicles on cross roads and squares mobilized with the traffic light signals, pay toll gates at highways, urban parking, security gates of governmental organizations, air ports, train stations, universities, and monorails and the like FIG. 1 illustrates a top view of a street accommodating panels and a display unit according to an embodiment of the present disclosure. With respect to FIG. 1, the basic parameters with respect to the street and the panels in accordance with an exemplary illustration are as listed below.

| | |
|---|---|
| 1-Minimum allowed height structure | 6 m (A/G.L.) |
| 2-Minimum safe height of Panels | 3 m |
| 3-Maximum space between the street lines | 3 m |
| 4-The Zebra crossing length | 5 m |
| 5-Maximum width of street | 18 m |
| 6-Maximum wind speed | 120 Km/hr |
| 7-The earthquake Coefficients. (Iranian regulation) | 2800(3) |
| 8-Maximum allowed time for panel upward motion | 4 Sec. |
| 9-Maximum allowed time for panel downward motion | 8 Sec. |
| 10-Power supply (Electric motor) | 220 V-50 Hz. |

The width of the cross road is 15 m with each of the panel being 2500 millimeters with total five such panels. The five movable fabric panels 10*a*, 10*b*, 10*c*, 10*d*, 10*e* are installed on a main steel structure. The structure consists of a main horizontal part (Fabric holder) and two columns which are laid down and anchored on two concrete foundations. The below mentioned Codes and reference standards are applied for design of the structure and foundation:

| | |
|---|---|
| 1-Steel structure Design | AISC-99 |
| 2-Concrete Foundation Design | ACI-318 |
| 3-Loading on the Structure (National Iranian Building Regulations) | (Sec. 6) |
| 4-Earthquake Coefficients | 2800-(3) |
| 5-Structural Design Software | SAP-2000 |
| 6-Concrete Foundation type | Separate |
| 7-Foundation Design Software | SAFE |

The adjacent distance between each of the panels is 500 meters. The maximum distance at which the panels are mounted in front of the cross road above the ground level is 6 meters and the maximum height at which each of the panels move downwards is 3 meters. Thus for example, a street with a width of 18 meters accommodates 6 panels in front of the cross road. The panels are arranged between two adjacent lines on a street to display at least one of traffic regulatory information and advertisements. Each of the panel is an LED panel 10*a*, 10*b*, 10*c*, 10*d*, 10*e*. The panel can also be a fabric panel, made of a suitable fabric which can provide for the winding and unwinding operation of the panel. The fabric panel 10*a*, 10*b*, 10*c*, 10*d*, 10*e* is a woven textile coated with polyester on both sides of the panel for environmental protection and reinforcement. Each of the panel is pliable and droppable which is used as a movable panel for displaying at least one of traffic regulatory information and advertisement. A display unit 11 is managed online from a traffic control centre to receive a real-time traffic information. The traffic control center is provided with a provision of "Green wave technique" to have a smooth traffic by installing the panels 10*a*-10*e* which recommends the optimum uniform speed for drivers passing from serial cross roads in green light condition. Also a plurality of sensors are arranged in the ground of the streets to measure the number of vehicles which are stopped in the cross road and automatically adjusts the red and green light period proportionally.

The fabric panel 10*a*-10*e* move downwards upon reception of a yellow light signal from other side of the cross road and the fabric panel 10*a*-10*e* move upwards upon reception of a succeeding yellow light signal from the other side of the cross road. The display unit 11 with 1.5 meters height and 5 meters length is installed on the front face of the cross road above the panels. The traffic control centre sends an online traffic message of adjacent streets to the drivers. Moreover the display unit 11 informs the drivers prior to be ready for receiving some special educational messages, films, voices and animation through Bluetooth associated with the driver devices during red light period. The display unit 11 is connected online to the cameras associated with the traffic control center to reflect various events on the adjacent streets. Examples of the events include, but are not limited to ambulances passing through the adjacent streets, Fire fighting trucks, police cars, and emergency events happening at the adjacent streets.

In some embodiments of the present disclosure, the display unit 11 is attached with loud speakers for sending educational and memorial messages related to famous scientists, and researchers. Also a radio frequency related to a special radio program is introduced to addresses. Further, using an embedded software and "FM" radio waves shown on the display unit 11, the drivers can receive the messages related to the pictures of panels through the drivers own radio.

Figure 2:
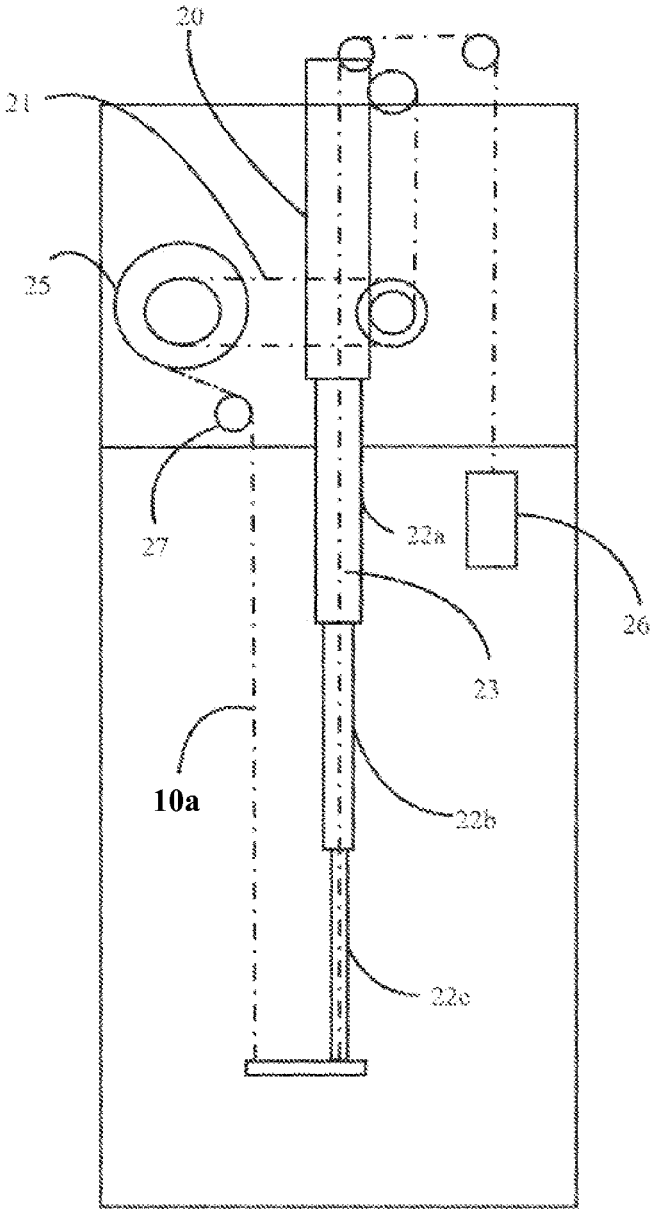
FIG. 2 illustrates a sectional view of a movement control mechanism for vertical movement of at least one panel on the cross road according to an embodiment of the present disclosure.
Figure 3:
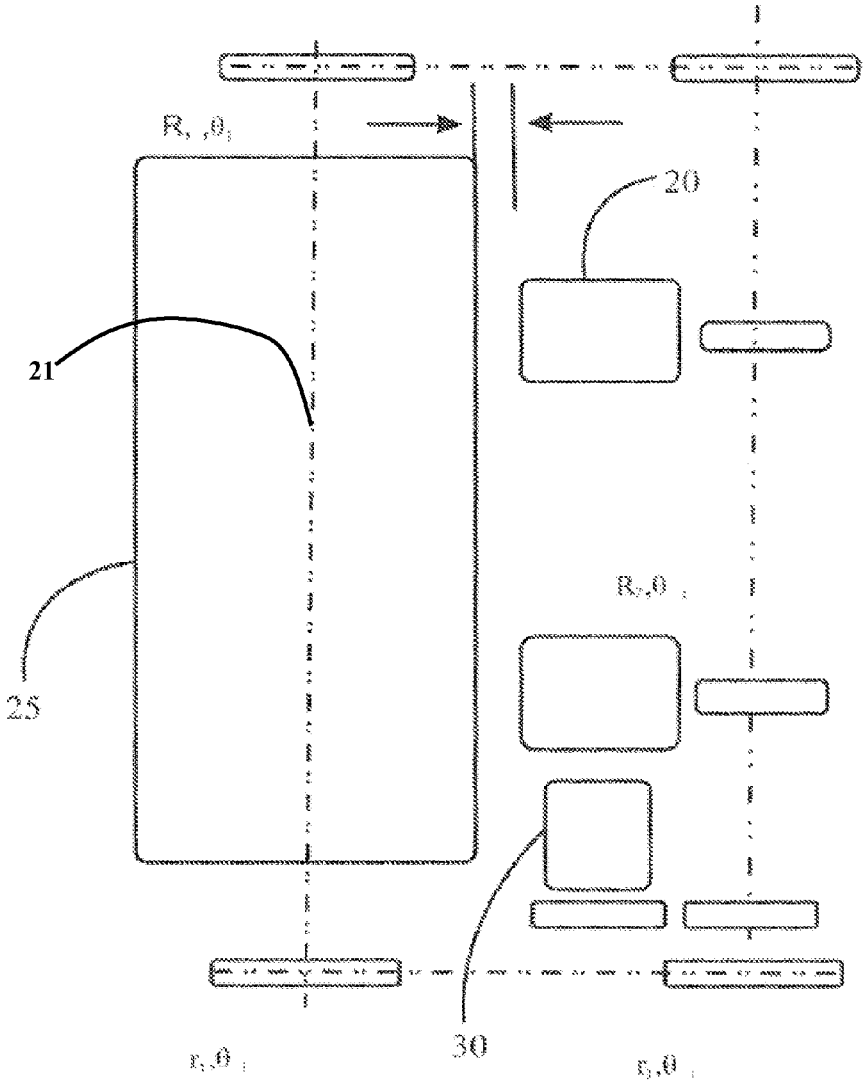
FIG. 3 illustrates a top sectional view of a movement control mechanism for vertical movement of at least one panel on the cross road according to an embodiment of the present disclosure.

FIG. 2 illustrates a sectional view of a movement control mechanism for the vertical movement of at least one panel on the cross road according to an embodiment of the present disclosure. With respect to FIG. 2, the movement control mechanism includes at least two telescopic arms 20 provided for the vertical motion of the at least one panel 10*a*-10*e*, an Electric motor, a gear box, a chain type transmission arrangement 21 and a magnetic coupler 30 (as shown in FIG. 3) placed between the electric motor and the chain type transmission arrangement. The telescopic arms 20 include a first movable part 22*a*, a second movable part 22*b*, a third movable part 22*c* and the fourth fixed part. The first movable part 22*a*, the second movable part 22*b* and the third movable part 22*c* are connected to each other by an internal cable wire 23 and are embedded into the fourth fixed part. With respect to the telescopic arms 20, the velocity of the second movable part 22*b* is two third velocity of the first moveable part 22*a* and velocity of the third movable part 22*c* is one third the velocity of the first movable part 22*a* during the upward motion of the panel 24. The panel is made up of a fabric panel 24 which is a woven textile coated with polyester on both sides of the panel 24 for environmental protection and reinforcement. Each of the panel is pliable and droppable which is used as a movable panel 24 for displaying at least one of traffic regulatory information and advertisements. A drum 25 is provided in the movement control mechanism for winding and unwinding the fabric on the drum 25 by rotating the drum around its axis during the upward motion and the downward motion of the fabric panel respectively. The drum 25 is a pipe with 8 inch diameter and 2600 millimeter length fabricated using a steel material.

During the upward motion or downward motion of the panel 24, the mechanical power is transmitted from the magnetic coupler and the chain type transmission arrangement 21 to the drum 25 and to the telescopic arms 20 for vertical motion. A counterweight arrangement 26 is provided in the movement control mechanism for the upward movement of the panel 24 during an electric power interruption. A tensioner 27 is provided in the movement control mechanism for reducing the extra length and shortening the length of the fabric panel 24 during the downward movement of the fabric panel 24. An AC drive is provided for controlling the speed of the electric motor and to prevent a shock during the start-up and stop condition of the movement control mechanism.

In various embodiments of the present disclosure, there exists a change in diameter of the drum during motion. For example, when thickness of the fabric material is 0.5 mm, the diameter of the drum is changed up to 23 mm due to the rolling of the fabric material on the drum. The error caused due to an increase in the diameter is damped using a spring type member. Considering the effect of a wind force on the fabric panel, a 120 km/hr wind speed produces a 70 kg/m$^2$ pressure on the surface of the fabric panel, and the fabric panel is capable of withstanding the above mentioned pressure. Considering the area of each panel to be 7.5 m2, a wind force equivalent to 525 kg is produced on the surface of the fabric panel. The 525 kg of force causes a tension force equivalent to 1372 kg on the fabric. The tension force so formed is transferred to the telescopic arms and to the drum. The fabric panel is capable of withstanding the above mentioned tension force. The below table shows the result of fabric forces due to wind and the tension force:

Fabric Analysis:

| | |
|---|---|
| Air Pressure | 70 Kg/m2 |
| Fabric strength | 92 N/mm |
| Fabric Max. Elongation | 16% |
| Fabric Elastic Modulus (E) | 575 N/mm |
| Fabric width (W) | 2500 mm |
| Fabric length (L) | 3000 mm |

-continued

| | |
|---|---|
| Fabric initial Tension | 10 mm |
| Fabric area | 7500000 mm2 |
| Fabric Drag Force | 5250 N Considering Wind |
| Fabric Angle (θ) | 22.1 deg Trial |
| Fabric Arc Length (S) | 3019 mm |
| Fabric Radius (r) | 7837 mm |
| Fabric initial elongation (ϵ) | 0.0033 Without wind |
| Fabric final elongation (ϵ) | 0.009541279 Considering wind |
| Fabric Initial Unit tension (T) | 1.92 N/mm Without wind |
| Fabric unit tension (T) | 5.49 N/mm Considering wind |
| Safety factor (Initial) | 48 Without wind |
| Safety factor | 17 Considering wind |
| Fabric Initial Tension Force (F) | 4792 N Without wind |
| Fabric Tension Force (F) | 13716 N Considering wind |
| Fabric Angle (θ) | 22.1 deg Error = −0.0003 |
| Fabric sag | 145 mm |

FIG. 3 illustrates a top sectional view of a movement control mechanism for the vertical movement of at least one panel on the cross road according to an embodiment of the present disclosure. With respect to FIG. 3, the movement control mechanism includes at least two telescopic arms provided for the vertical motion of the at least one panel, an Electric motor, a gear box, a chain type transmission arrangement 21 and a magnetic coupler 30 placed between the electric motor and the chain type transmission arrangement 21. The telescopic arms 20 includes a first movable part 22*a* (as shown in FIG. 2), a second movable part 22*b* (as shown in FIG. 2) and a third movable part 22*c* (as shown in FIG. 2) all embedded into a fourth fixed part, connected to each other by an internal wire cable. With respect to the telescopic arms 20, the velocity of the second movable part 22*b* is two third velocity of the first moveable part 22*a* and velocity of the third movable part 22*c* is one third the velocity of the first movable part 22*b* during upward motion of the panel.

The panel is made up of one of a fabric panel 24 which is a woven textile coated with polyester on both sides of the panel for environmental protection and reinforcement. Each of the panel 24 is pliable and droppable which is used as a movable panel for displaying at least one of traffic regulatory information and advertisements. A drum is provided in the movement control mechanism for winding and unwinding the fabric on to the drum by rotation of the drum around its axis during upward motion and downward motion of the fabric panel respectively. The drum is a pipe with 8 inch diameter and 2600 millimeter length fabricated using a steel material.

During the upward or downward motion of the panel, mechanical power is transmitted from the magnetic coupler and the chain type transmission arrangement to the drum and to the telescopic arms for vertical motion. A counterweight arrangement is provided in the movement control mechanism for upward movement of the panel during an electric power interruption. A tensioner is provided in the movement control mechanism for reducing the extra length and shortening the length of the fabric panel caused during the downward movement of the fabric panel. An AC drive is provided for controlling the speed of the electric motor and to prevent a shock during the start-up and stop conditions of the movement control mechanism.

Figure 4:
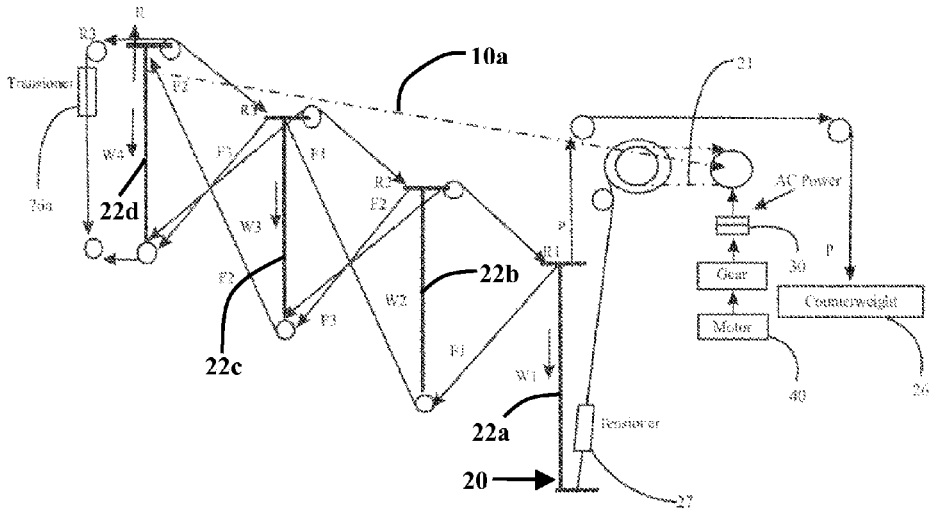
FIG. 4 illustrates a sectional view of a movement control mechanism for vertical movement of at least one panel on the cross road according to an embodiment of the present disclosure according to an embodiment of the present disclosure.

FIG. 4 illustrates a sectional view of a movement control mechanism for the vertical movement of at least one panel on the cross road according to an embodiment of the present disclosure. The movement control mechanism includes at least two telescopic arms provided for the vertical motion of the at least one panel, an Electric motor, a gear box, a chain type transmission arrangement 21 and a magnetic coupler 30 placed between the electric motor and the chain type transmission arrangement. The telescopic arms 20 includes a first movable part 22*a*, a second movable part 22*b* and a third movable part 22*c* all embedded into a fourth fixed part, connected to each other by an internal wire cable. With respect to the telescopic arms 20, the velocity of the second movable part is two third velocity of the first moveable part and the velocity of the third movable part is one third the velocity of the first movable part during the upward motion of the panel. The panel is made up of one of a fabric panel which is a woven textile coated with polyester on both sides of the panel for environmental protection and reinforcement. Each of the panel is pliable and droppable which is used as a movable panel for displaying at least one of traffic regulatory information and advertisements. A drum is provided in the movement control mechanism for winding and unwinding the fabric on the drum by rotating the drum around its axis during the upward motion and the downward motion of the fabric panel respectively. The Drum is a pipe with 8 inch diameter and 2600 millimeter length fabricated using a steel material.

During the upward or the downward motion of the panel, a mechanical power is transmitted from the magnetic coupler and the chain type transmission arrangement to the drum and to the telescopic arms for vertical motion. A counterweight arrangement 26 is provided in the movement control mechanism for the upward movement of the panel during the electric power interruption period. A tensioner 27 is provided in the movement control mechanism for reducing the extra length and shortening the length of the fabric panel caused during the downward movement of the fabric panel. An AC drive is provided for controlling the speed of the electric motor and to prevent a shock during the start-up and stop condition of the movement control mechanism.

Figure 5A:
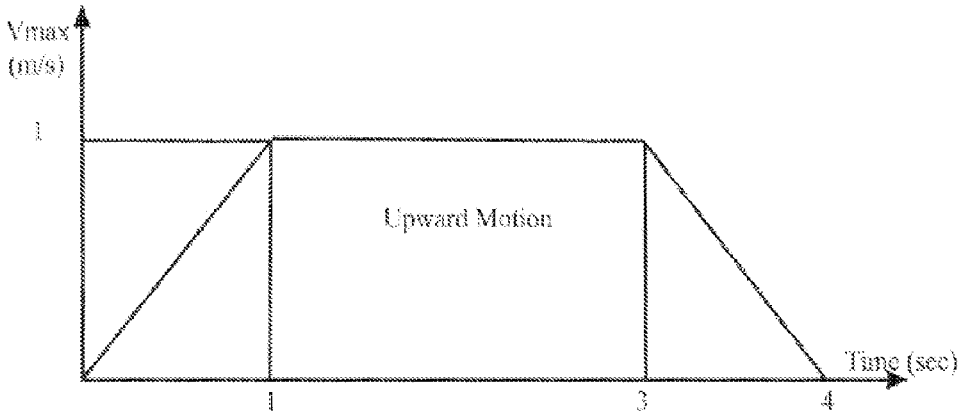
FIG. 5*a* is a graph illustrating the velocity of panel during upward motion of the panel with respect to time according to an embodiment of the present disclosure.

FIG. 5*a* is a graph illustrating the velocity of panel during the upward motion of the panel with respect to time according to an embodiment of the present disclosure. With respect to FIG. 5*a*, the velocity of the at least one panel increases linearly until one second and attains a constant value of one meter/second for next two seconds. Further, the velocity of the at least one panel linearly decreases for next one second and attains zero value at fourth second. Thus the total duration for an upward movement of the panel is four seconds. The below details provide various parameters with respect to the panel during the upward motion of the panel:

| | | |
|---|---|---|
| 1-Duration (Upward motion of the panel) | 4 | Sec. |
| 2-Maximum speed of lower part (w1) | 1 | m/s |
| 3-Maximum speed of middle part (w2) | .66 | m/s |
| 4-Maximum speed of upper part (w3) | .33 | m/s |
| 5-Maximum speed of the drum | 87.17 | rpm |
| 6-Maximum speed of outlet shaft of chain type arrangement | 43.58 | rpm |
| 7-Maximum chain speed part (w1) | .33 | m/s |
| 8-Motor speed | 1480 | rpm |
| 9-Transmission ratio | 34:1 | |

Figure 5B:
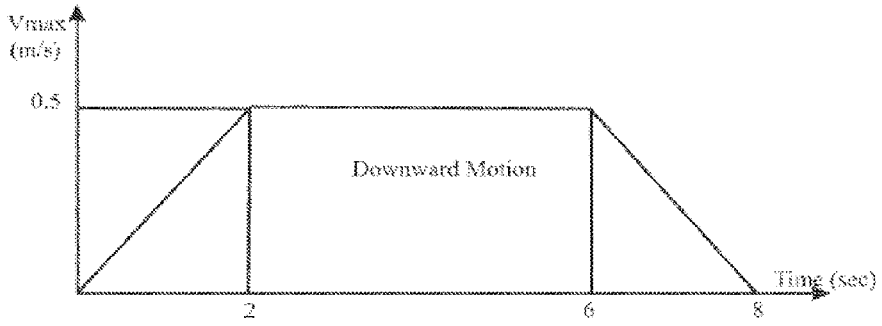
FIG. 5*b* is a graph illustrating the velocity of panel during downward motion of the panel according to an embodiment of the present disclosure.

FIG. 5*b* is a graph illustrating the velocity of panel during the downward motion of the panel according to an embodiment of the present disclosure. With respect to FIG. 5*b*, the velocity of the panel increases linearly until two seconds and attains a constant value of 0.5 meter/second for next four seconds. Further, the velocity of the panel linearly decreases for next two seconds and attains zero value at the eighth second. Thus the total duration for the upward movement of the panel is eight seconds. The various parameters with respect to the panel during the downward motion of the panel are listed below.

| | | |
|---|---|---|
| 1-Duration | 8 | Sec. |
| 2-Maximum speed of lower part (w1) | 0.5 | m/s |
| 3-Maximum speed of middle part (w2) | .33 | m/s |
| 4-Maximum speed of upper part (w3) | .16 | m/s |
| 5-Maximum speed of the drum | 43.58 | rpm |
| 6-Maximum speed of outlet shaft of chain type trans. system | 21.8 | rpm |
| 7-Maximum chain speed on w1 | .163 | m/s |
| 8-Motor speed | 1480 | rpm |
| 9-Transmission ratio | 68:1 | |

Figure 6A:
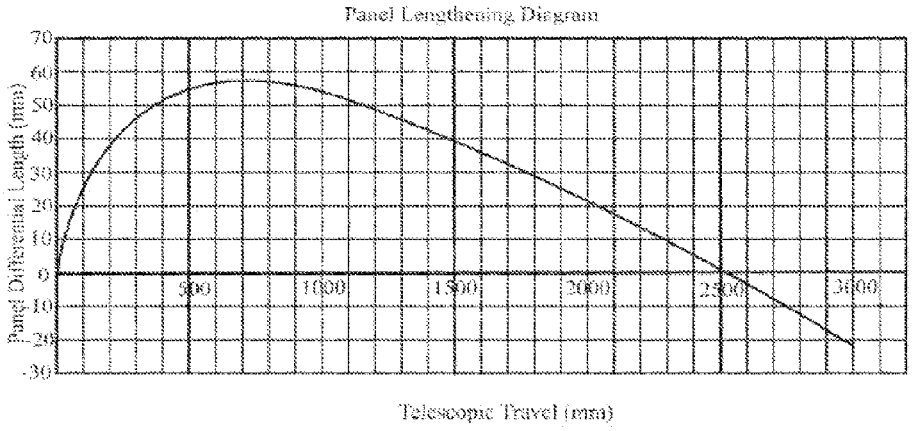
FIG. 6*a* is a graph illustrating the variation in length of the fabric panel with respect to a change in distance of the telescopic arms in the movement control mechanism in the absence of a tensioner according to an embodiment of the present disclosure.

FIG. 6*a* is a graph illustrating the variation in the length of the fabric panel with respect to the change in distance of the telescopic arms provided in the movement control mechanism in the absence of a tensioner according to an embodiment of the present disclosure. An extra increase or decrease in the length of the fabric panel 24 takes place due to a horizontal eccentricity between the centerline of the telescopic arms and the drum as follows. With respect to the graph (FIG. 6*a*), when the panel 24 moves 700 mm downward, the fabric length will have an extra length of 58 mm and is loosened or deformed. Further, when the fabric moves 3000 mm downward, the fabric length is shortened to 58 mm in length through which the fabric is tightened and gets stretched along its length.

Figure 6B:
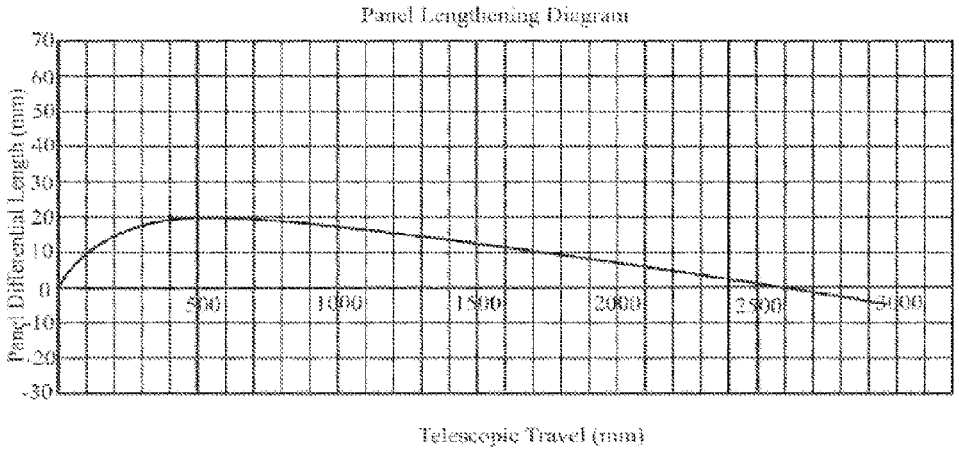
FIG. 6*b* is a graph illustrating the variation in the length of the fabric panel with respect to the change in distance of the telescopic arms in the movement control mechanism in presence of a tensioner according to an embodiment of the present disclosure.

FIG. 6*b* is a graph illustrating the variation in the length of the fabric panel 24 with respect to the change in distance of the telescopic arms provided in the movement control mechanism in presence of a tensioner according to an embodiment of the present disclosure. With respect to FIG. 6*b*, 58 mm extra length of the fabric (as illustrated in FIG. 6*a*) is reduced to 18 mm and shortening is reduced from 22 mm to 5 mm.

Figure 7:
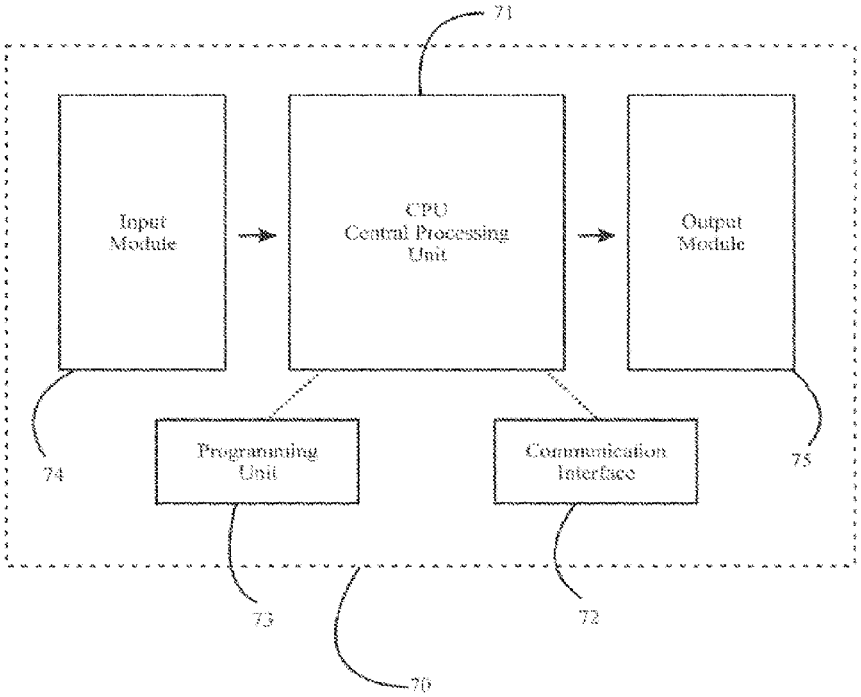
FIG. 7 shows the block diagram of a control system with a Programmable Logic Controller (PLC) according to an embodiment of the present disclosure.

FIG. 7 illustrates the block diagram of a control system with a Programmable Logic Controller (PLC) according to an embodiment of the present disclosure. With respect to FIG. 7, the PLC 70 includes a central processing unit 71 for processing input and output operations of the PLC, a communication interface 72 in electronic communication with the central processing unit, a programming unit 73 for loading an algorithm for managing the position of the at least one panel based on the traffic light status across the cross road. Also the PLC includes an input module 74 for receiving a time scheduled information from the plurality of sensors based on the traffic and an output module 75 for transmitting one of a start signal or stop signal for an electric motor starter and delivering the time schedule information for displaying the information. The various inputs and outputs of the PLC are listed in the table below:

| |
|---|
| A)LIGHT SIGNAL = DI × 4 (Red, Yellow, Yellow other side, Green) |
| B)MOTOR RUNING = DI × 5 |
| C)MOTOR FUALT = DI × 5 |
| D)START/STOP = DO × 10 |
| E)HIGH SPEED = DO × 5 |
| F)LOW SPEED = DO × 5 |
| G)ENCODER = DI(PULSE) × 10 |
| H)TWO DIRECTION = DO × 5 |
| I)LIMIT SWITCH(DOWN AND UP) = DI × 10 |
| J)HIGH HEIGHT OBJECT DETECTION = DI × 5 |

Figure 8:
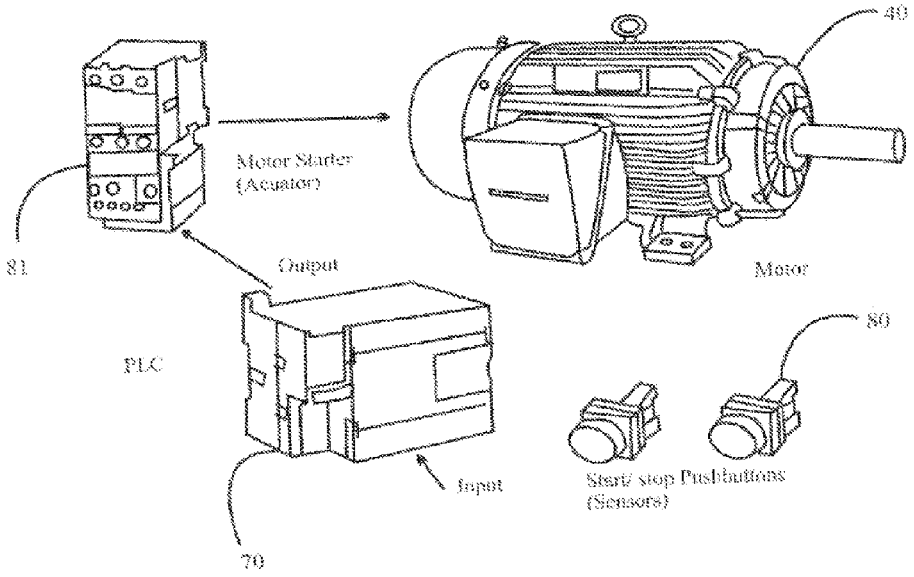
FIG. 8 illustrates components of the AC drive system for a motor in control system according to an embodiment of the present disclosure.

FIG. 8 illustrates the components of the AC drive in the control system according to an embodiment of the present disclosure. The AC drive includes various electronic components such as start and stop buttons 80, PLC 70, a motor starter 81 connected to an electric motor. The electric motor (as shown in FIG. 4) has two speeds levels and rotates in two opposite directions smoothly during the start-up and stop situation using the AC drive.

Figure 9:
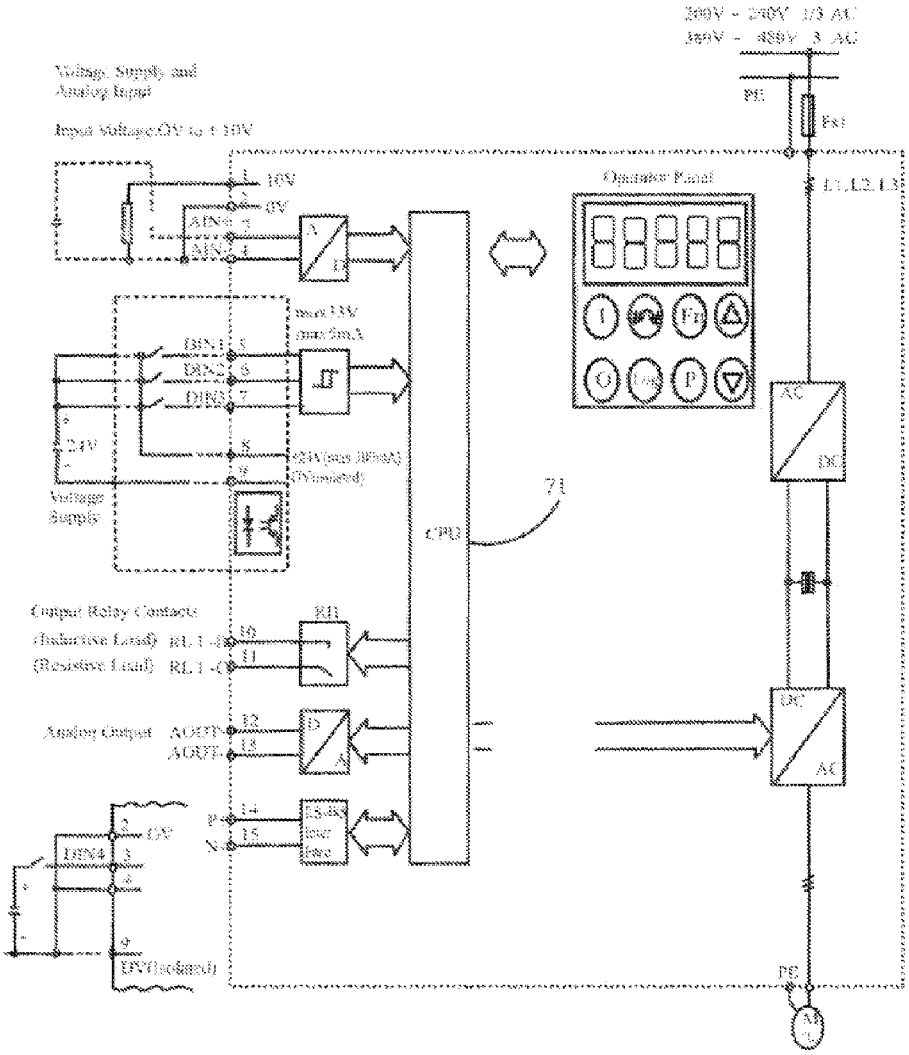
FIG. 9 illustrates circuit diagram of the control system according to an embodiment of the present disclosure.

FIG. 9 illustrates a circuit diagram of the control system connected to an operator panel according to an embodiment of the present disclosure. With respect to FIG. 9, the PLC is a microprocessor with multi Input-Output ports. The output signals are activated by the Input signals through an algorithm loaded into the microprocessor. The algorithm loaded into the microprocessor manages the panel position based on the traffic light conditions on a cross road.

Figure 10:
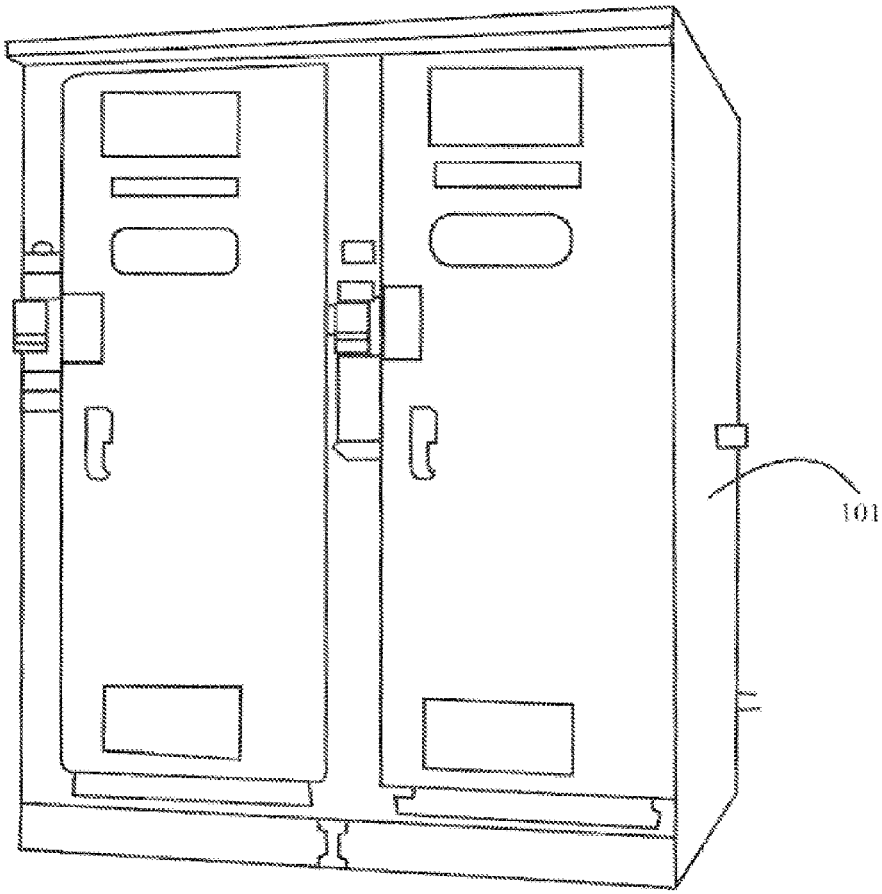
FIG. 10 illustrates a perspective view of a control system according to an embodiment of the present disclosure.

FIG. 10 illustrates a perspective view of a control panel according to an embodiment of the present disclosure. With respect to FIG. 10, a Programmable Logic Controller (PLC) (as shown in FIG. 7), Plurality of sensors, and AC drive (as shown in FIG. 8) are embedded into the control panel 101 made of steel material.

Figure 11A:
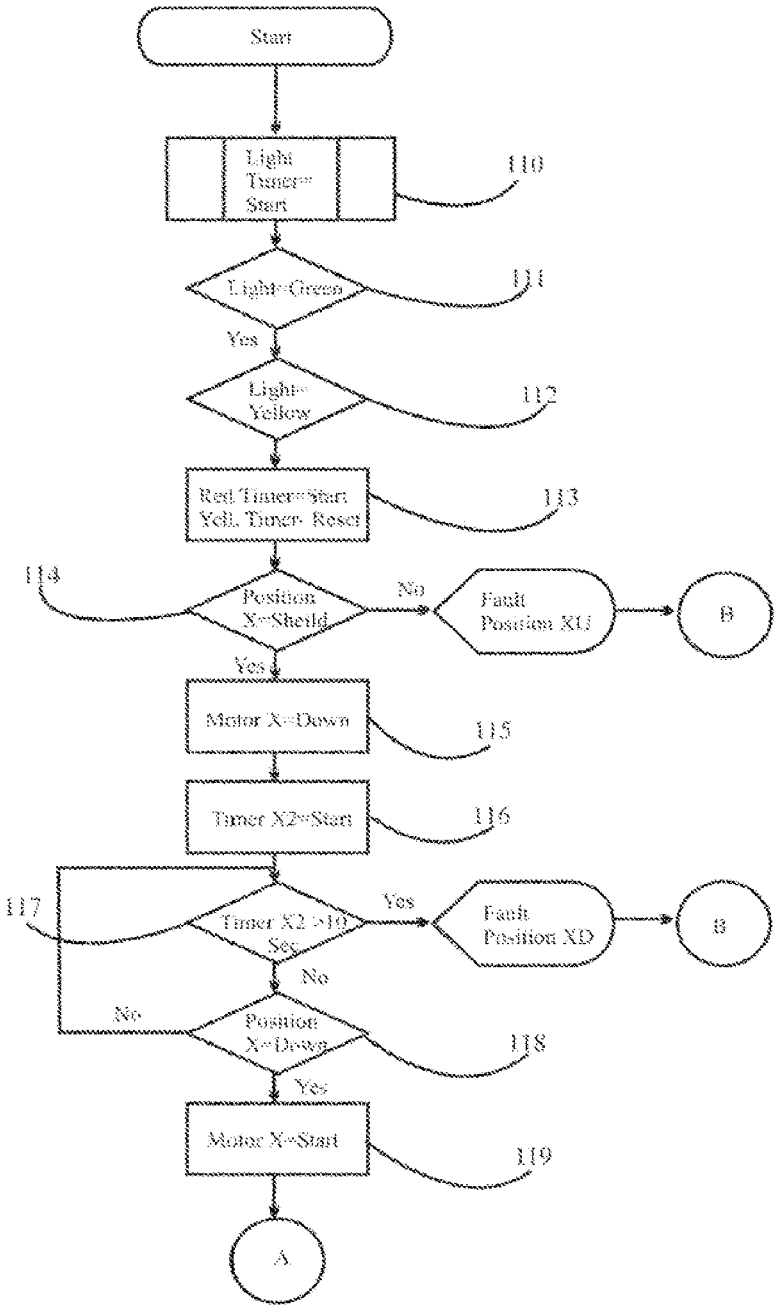
FIG. 11 is a flowchart illustrating a method for controlling the movement of display panel for displaying the information to vehicles on the cross road according to an embodiment of the present disclosure.
Figure 11B:
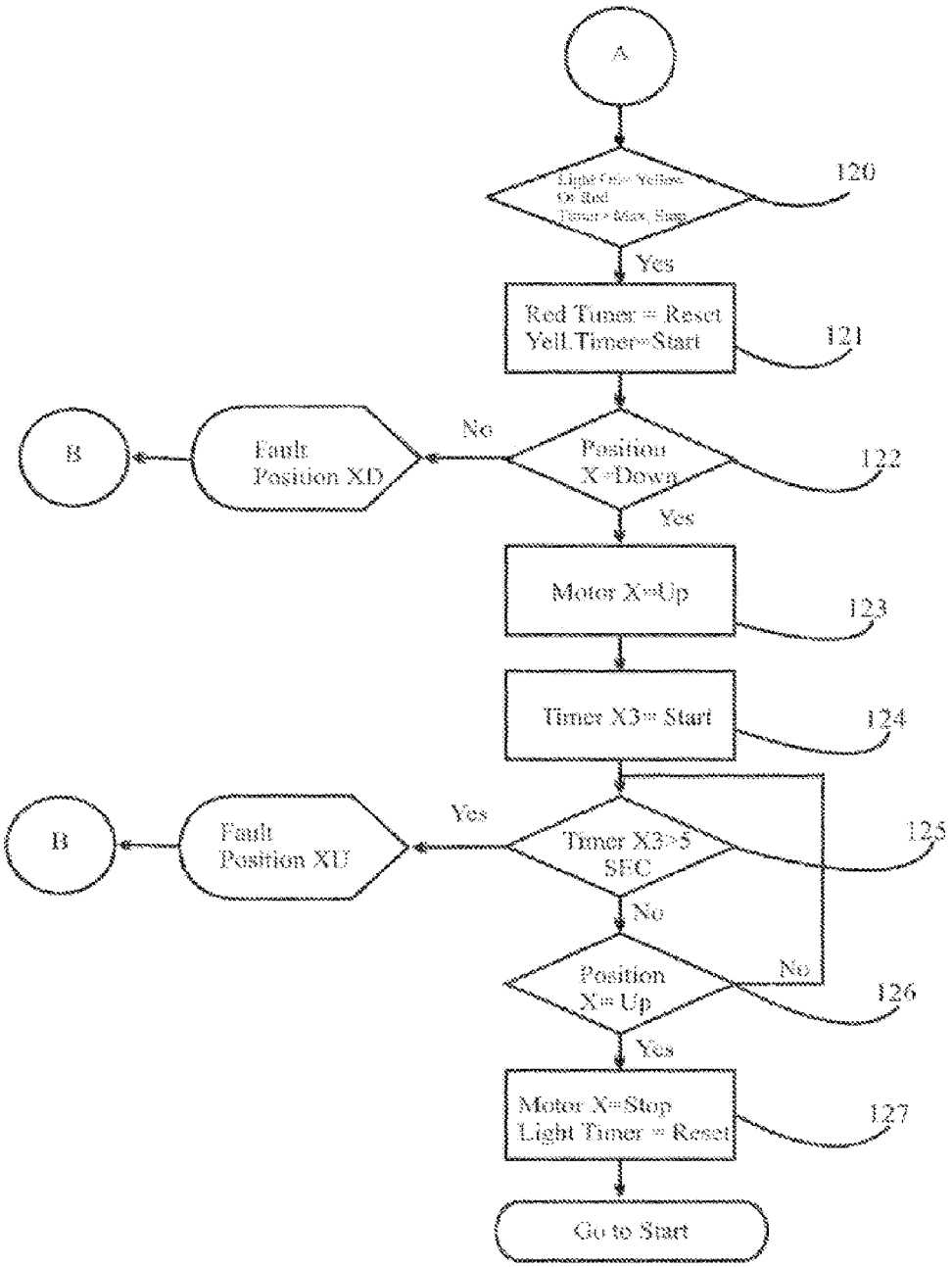
Figure 11C:
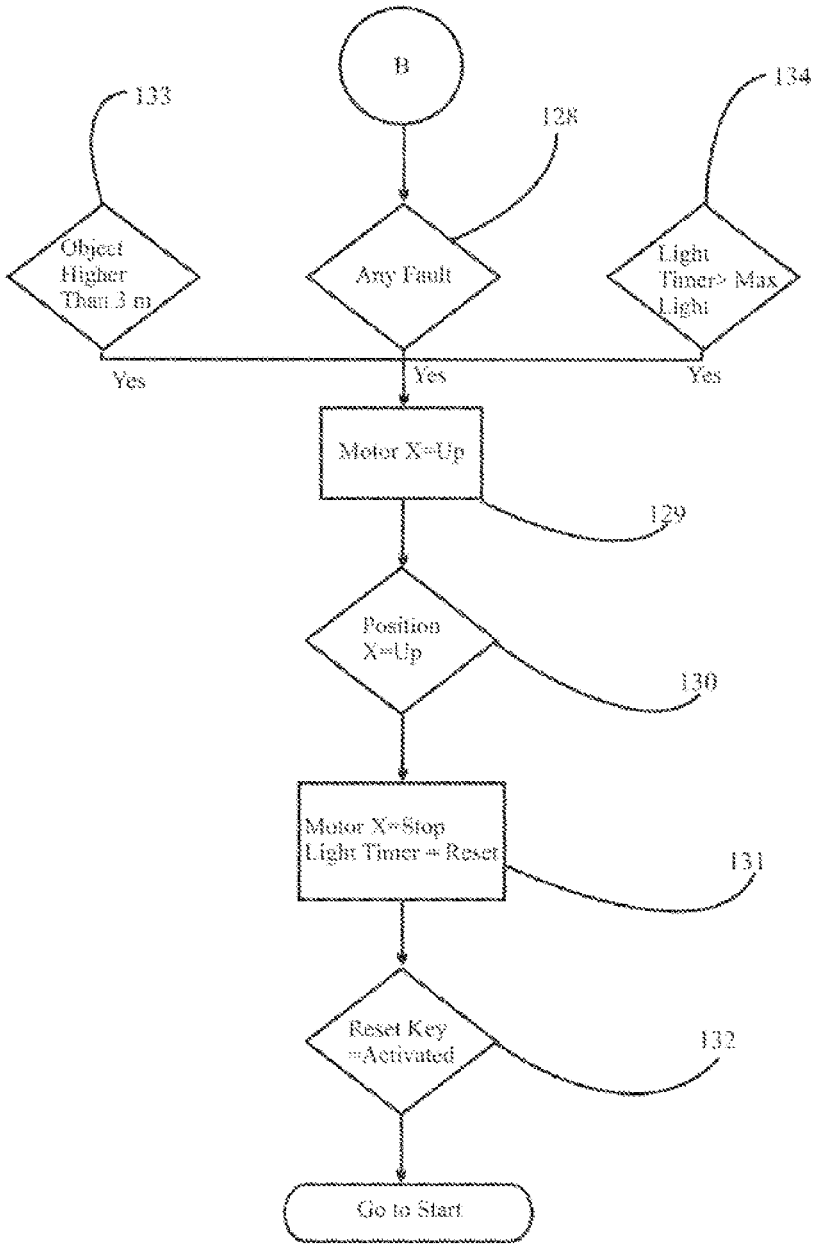

FIG. 11 is a flow chart illustrating a method for managing the information display for vehicles on the cross roads according to an embodiment of the present disclosure. With respect to FIG. 11, a light timer is started (110). Firstly the control system senses for a green light (111). After sensing and receiving the green light signal, the system senses for a yellow light signal (112). Upon the reception of the yellow light signal, a red light timer is started and a yellow light signal is reset (113). The position of a panel is checked (X=Shield) (114). When the checked panel position is at (X=Shield) then a downward command signal is activated for the downward movement of the panel (115). When the checked panel position is not (X=Shield), then the system reaches a fault mode condition (128). After performing the downward movement of the panel (115), a second timer is started (116). The second timer is checked for a predefined value of 10 seconds (117). When the second timer exceeds 10 seconds, then the system enters a fault mode condition (128). When the second timer does not exceed 10 seconds, the position of the panel is checked to find whether the panel is held down (118). When the panel is held down, then the motor in the control system is stopped (119).

Further one of a yellow light signal or red light signal is checked and simultaneously the timer is checked for the maximum value (120). After the checking operation (120), the red timer is reset and the yellow timer is started (121). The position of the panel is checked (X=down) (122). When the checked panel position is at (X=down) a downward position, then an upward command signal is activated for the upward movement of the panel (123). When the checked panel position is not (X=down) in the downward position, then the system reaches a fault mode condition (128). After the process, a third timer is started (124). The third timer is checked for a predefined value of 5 seconds (125). When the second timer exceeds 5 seconds, then the system enters a fault mode condition (128). When the second timer does not exceed 5 seconds, the position of the panel is checked to find whether the panel is held up (126). When the panel is found to be in held up condition, then motor in the control system is stopped (127) and the light timer is reset (127).

During one of a fault mode condition (128), in which an object is higher than 3 meters (133) or light timer exceeds a predefined value, an upward command signal is activated for the upward movement of the panel (130). Once the panel is moved up, the motor is stopped and the light timer is reset (131). After the reset of the light timer, the reset signal is activated for resetting the timer.

Figure 12:
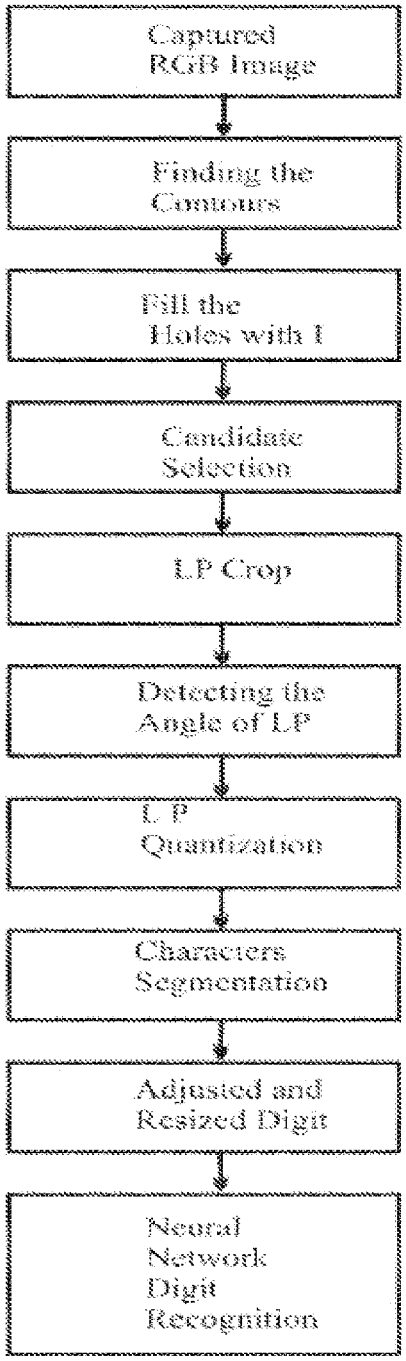
FIG. 12 is a flowchart illustrating a method of identification of a vehicle number plate in a vehicle at cross roads according to an embodiment of the present disclosure.

FIG. 12 is a flowchart illustrating the identification of a vehicle number in a number plate of a vehicle according to an embodiment of the present disclosure. During a vehicle identification process, a control system scans the vehicle number of the offenders and registers them in a central police station. When a vehicle interrupt signal is received from a plurality of sensors located on both the sides of the zebra lines by crossing, the cameras captures the photograph of the number plate and the vehicle through a PLC and sends the information associated with the offender to the central police station. Examples of the information associated with an offender include, but are not limited to a vehicle number, date and time of committing an offence and an address.

The cameras are installed in various angles across a panel or across the cross roads. For example, when a car passes through the cross roads during the red light period or a truck with un allowed height passes through the cross roads or a driver rides a vehicle at an unregulated speed, the cameras scans the car from various angles and detects the car or the truck number and sends the received information to a police security network through an internet for registration and issuing statement. Moreover the police security network identifies the driver by the detected number. Further, by connecting the system to a telecommunication center, the statement along with pictures of the car and with highlighted time of event is sent to the driver through a Multimedia Messaging Service (MMS).

Although the embodiments herein are described with various specific embodiments, it will be obvious for a person skilled in the art to practice the embodiments herein with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A system for managing information display for vehicles on cross roads, the system comprising:

at least one panel to display at least one of a traffic regulatory information and advertisements, and wherein the at least one panel is a fabric panel or a LED panel;

a central server;

a programmable logic controller (PLC) connected to the central server to manage an information displayed on the at least one panel based on a traffic light information;

a plurality of sensors arranged at a defined elevation to detect a position of the at least one panel and to detect any moving foreign object;

a display unit managed online from a traffic control centre to display a real-time traffic information; and a plurality of timers for calculating a time schedule information of a plurality of traffic lights based on a traffic condition;

a movement control mechanism for a vertical movement of the at least one panel on the cross road, and wherein the movement control mechanism comprises at least two telescopic arms, an electric motor, a gear box, a chain type transmission arrangement, a magnetic coupler and an AC drive, and wherein the at least two telescopic arms is provided for a vertical movement of the at least one panel, and wherein the magnetic coupler is placed between the electric motor and the chain type transmission arrangement, and wherein the AC drive is adapted to control a speed of the electric motor and to prevent a shock during a start condition and a stop condition of the movement control mechanism;

an encoder adapted to control the vertical movement of the at least one panel and an actual position estimation of the at least one panel to the PLC;

wherein the plurality of sensors control the time schedule information and transmits the time schedule information to the PLC which further transmits the time schedule information and traffic algorithms to a central control system residing in the central server in an online mode for processing and displaying the information on the panel to avoid a probable traffic jam on adjacent cross roads, and wherein the plurality of sensors are adapted to retract the at least one panel from a downward position during a power interruption or network impairment, and wherein the fabric panel along with the two telescopic arms moves downwards upon reception of a yellow light from at least one traffic signal mounted at an opposite side of the cross road and wherein the fabric panel along with the two telescopic arms moves upwards upon reception of succeeding yellow light from at least one traffic signal mounted from the other side of the cross road.

2. The system of claim 1, wherein the traffic regulatory information comprising:

an information associated to traffic signs;

a speed limit of a vehicle;

a status of a traffic light; and an information indicating a change in a direction of travel to adjacent streets during a traffic jam condition.

3. The system of claim 1, wherein the display unit is connected to a plurality of cameras associated with the traffic control centre to obtain the real-time traffic information related to various traffic events on adjacent streets.

4. The system of claim 1, wherein the PLC is connected to the central server through a wired network or a wireless network.

5. The system of claim 1, wherein the PLC comprises:

a central processing unit for processing an input operation and an output operation of the PLC;

a communication interface in electronic communication with the central processing unit;

a programming unit for loading an algorithm for managing the position of the at least one panel based on a traffic light status across the cross road;

an input module for receiving the time schedule information from the plurality of sensors based on the traffic condition; and an output module for transmitting a start signal or a stop signal for a starter of an electric motor for the at least one panel and delivering the time schedule information to the display unit.

6. The system of claim 1, wherein the telescopic arms comprises a first movable part, a second movable part, a third movable part and a fourth fixed part and wherein the first movable part, the second movable part and the third movable part are interconnected by an internal cable wire and are embedded into the fourth fixed part.

7. The system of claim 1, wherein the movement control mechanism further comprising a drum adapted to rotate at an axis to perform a winding of a fabric on the drum during an upward movement of the fabric panel and an unwinding of the fabric from the drum during a downward movement of the fabric panel.

8. The system of claim 1, wherein the movement control mechanism further comprising a counterweight arrangement to regulate the upward movement of the at least one panel during the power interruption.

9. The system of claim 1, wherein the movement control mechanism further comprising a tensioner adapted to reduce an additional length of the fabric panel and shortening a length of the fabric panel during the downward movement of the fabric panel.

10. The system of claim 1, wherein the PLC, the sensors and the AC drive are embedded in a steel control panel.

11. A method for managing information display for vehicles on cross roads, the method comprises:

sensing for a green light from at least one signal mounted at one opposite side of a cross road;

receiving the green light from at least one signal mounted at one opposite side of the cross road;

detecting a yellow light from at least one signal mounted at one opposite side of the cross road;

receiving the yellow light from at least one signal mounted at one opposite side of the cross road;

activating a downward command signal for a downward movement of an at least one panel; and reporting an actual position of the at least one panel to a Programmable Logic Controller (PLC); and displaying at least one information on the at least one panel;

Wherein the PLC is programmed with an algorithm for managing the at least one panel based on a traffic light status across the crossroad.

12. The method of claim 11, further comprises:

sensing for a succeeding yellow light signal;

receiving the succeeding yellow light signal; and activating an upward command signal for an upward movement of the at least one panel.

13. The method of claim 12, further comprises:

specifying a set point for sensing the green light signal;

receiving the green light signal;

detecting the yellow light signal;

receiving the yellow light signal;

activating the downward command signal;

sensing the succeeding yellow light signal;

receiving the succeeding yellow light signal;

activating the upward command signal; and comparing current values with the specified set points to check a duration of each traffic signal.

14. The method of claim 11 further comprises:

initiating a fault mode condition when the specified set point crosses a predefined value; and activating the upward command signal for the upward movement of the at least one panel.

* * * * *